US010384142B2

(12) United States Patent
Naney et al.

(10) Patent No.: US 10,384,142 B2
(45) Date of Patent: Aug. 20, 2019

(54) SELECTING INFRARED TRANSMISSION MODES BASED ON USER ACTIONS

(71) Applicant: Disney Enterprises, Inc., Burbank, CA (US)

(72) Inventors: David Tillman Naney, Lake Balboa, CA (US); Philippe Putzeys, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 80 days.

(21) Appl. No.: 14/934,344

(22) Filed: Nov. 6, 2015

(65) Prior Publication Data

US 2017/0128851 A1 May 11, 2017

(51) Int. Cl.

| | |
|---|---|
| ***A63H 3/36*** | (2006.01) |
| ***A63H 30/00*** | (2006.01) |
| ***A63H 33/00*** | (2006.01) |
| ***A63H 30/04*** | (2006.01) |
| ***A63H 33/26*** | (2006.01) |

(52) U.S. Cl.

CPC ..... *A63H 30/04* (2013.01); *A63H 3/36* (2013.01); *A63H 30/00* (2013.01); *A63H 33/00* (2013.01); *A63H 33/26* (2013.01)

(58) Field of Classification Search

CPC ..... A63H 33/00; A63H 30/00; A63H 30/04; A63H 2200/00; A63H 3/36; A63H 33/26; A63F 9/24

See application file for complete search history.

(56) References Cited

U.S. PATENT DOCUMENTS

| | | | | |
|---|---|---|---|---|
| 4,802,675 | A * | 2/1989 | Wong | F41A 33/02 362/277 |
| 4,828,525 | A * | 5/1989 | Okano | A63H 13/02 446/175 |
| 6,302,796 | B1 * | 10/2001 | Lebensfeld | A63F 9/0291 446/175 |
| 7,896,742 | B2 * | 3/2011 | Weston | A63H 30/04 463/37 |
| 8,439,720 | B2 * | 5/2013 | Inoue | A63F 9/0291 434/11 |
| 8,845,431 | B2 * | 9/2014 | Langridge | G06F 3/017 463/30 |
| 2003/0027640 | A1 * | 2/2003 | Jeffway, Jr. | F41A 33/02 463/49 |

(Continued)

*Primary Examiner* — Eugene L Kim
*Assistant Examiner* — Alyssa M Hylinski
(74) *Attorney, Agent, or Firm* — Patterson + Sheridan, LLP

(57) ABSTRACT

Embodiments herein use multiple different transmission modes of a line-of-sight (LOS) communication system (e.g., an infrared (IR) or visible light communicate system) to simulate user actions that correspond to different distances—e.g., a melee attack versus a ranged attack. A toy device may include various sensors that detect user motion which is then used to identify a user action. If the user action is a melee attack, then the attack should affect only targets that are close to the toy device. To simulate this difference between user actions, the toy device uses a first LOS transmission mode which may have a limited range to send an instruction to a target device. Conversely, if the user action is a ranged attack, then the toy device uses a second LOS transmission mode which has a greater range than the first LOS transmission mode to send the instruction.

20 Claims, 6 Drawing Sheets

(56) References Cited

U.S. PATENT DOCUMENTS

| | | | | |
|---|---|---|---|---|
| 2005/0159077 | A1* | 7/2005 | Maeda | A63H 30/04<br>446/454 |
| 2005/0186884 | A1* | 8/2005 | Evans | A63H 17/14<br>446/456 |
| 2007/0060018 | A1* | 3/2007 | Chou | A63H 17/045<br>446/456 |
| 2015/0091694 | A1* | 4/2015 | Degtyarev | A63H 17/36<br>340/5.51 |

* cited by examiner

SELECTING INFRARED TRANSMISSION MODES BASED ON USER ACTIONS

BACKGROUND

Field of the Invention

Embodiments presented in this disclosure generally relate to selecting infrared transmission modes according to identifying user actions.

Description of the Related Art

Computer graphics technology has come a long way since video games were first developed. Relatively inexpensive 3D graphics engines now provide nearly photo-realistic interactive game play on hand-held video game, home video game and personal computer hardware platforms costing only a few hundred dollars. These video game systems typically include a hand-held controller, game controller, or, in the case of a hand-held video game platform, an integrated controller. A user interacts with the controller to send commands or other instructions to the video game system to control a video game or other simulation. For example, the controller may include a joystick and buttons operated by the user.

While video games allow the user to interact directly with the video game system, such interactions primarily influence the graphical depiction shown on the video game device (or on a connected display), and rarely influence any other objects outside of the virtual world. That is, a user may specify an input to the video game system, indicating that the user's avatar should perform a jump action, and in response the video game system displays the user's avatar jumping. However, such interactions are typically limited to the virtual world, and any interactions outside the virtual world are limited (e.g., a hand-held gaming device could vibrate when certain actions occur).

SUMMARY

One embodiment described herein is a method of operating a toy device. The method includes detecting user motion using the toy device and selecting a user action from a plurality of predefined user actions based on the user motion. The method also includes selecting a line-of-sight (LOS) transmission mode from a plurality of LOS transmission modes based on the selected user action, where each of the LOS transmission modes corresponds to a different transmission pattern. The method includes transmitting a signal corresponding to the selected action using a LOS communication system operating in the selected LOS transmission mode.

Another embodiment described herein is computer-readable storage medium that includes computer-readable program code executable by one or more computer processors to perform an operation. The operation includes detecting user motion using a toy device and selecting a user action from a plurality of predefined user actions based on the user motion. The operation also includes selecting a LOS transmission mode from a plurality of LOS transmission modes based on the selected user action where each of the LOS transmission modes corresponds to a different transmission pattern. The method includes transmitting a signal corresponding to the selected action using a LOS communication system operating in the selected LOS transmission mode.

Another embodiment described herein is a toy device that includes a LOS communication system, at least one sensor, and control logic. The control logic is configured to detect user motion using the at least one sensor and select a user action from a plurality of predefined user actions based on the user motion. The control logic is configured to select a LOS transmission mode from a plurality of LOS transmission modes based on the selected user action, where each of the LOS transmission modes corresponds to a different transmission pattern. The control logic is configured to instruct the LOS communication system to transmit a signal corresponding to the selected action while operating in the selected LOS transmission mode.

BRIEF DESCRIPTION OF THE DRAWINGS

So that the manner in which the above recited aspects are attained and can be understood in detail, a more particular description of embodiments of the invention, briefly summarized above, may be had by reference to the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

An immersive storytelling environment can use one or more storytelling devices (also referred to as interactive devices) that are each capable of producing some auditory and/or visual effect, to create an immersive and interactive storytelling experience for a user. In one embodiment, the actions performed by the storytelling devices may vary depending one a user action. For example, in a simulated battle scenario, the user action may dictate what type of attack the user has directed at a target. For example, the user action may simulate a melee attack which is performed at close range such as a punch, sword swing, thrust, and the like. Alternatively, the user action may be a ranged attack that can affect a target at longer distances such as shooting an arrow, emitting a shockwave, causing an earthquake, shooting a laser, etc. In immersive environments that use physical storytelling devices, simulating the differences between a melee and ranged attack can be difficult.

The embodiments herein use two different transmission modes of a line-of-sight (LOS) communication system (e.g., an infrared (IR) or visible light communicate system) to simulate user actions that correspond to different distances—e.g., a melee attack versus a ranged attack. A toy device may include various sensors that detect user motion which is then used to identify a user action. If the user action is a melee attack, then the attack should only affect targets that are close to the toy device. In one embodiment, the toy device uses a first LOS transmission mode which may have a limited range to send an instruction to a target device. Thus, only targets within the limited range receive the instruction.

Conversely, if the user action is a ranged attack, then the toy device uses a second LOS transmission mode to send the instruction which has a greater range than the first LOS transmission mode. For example, the first transmission mode may attenuate the output power of an IR transmitter that transmits the instruction, and thus, any target devices that are outside the range of the LOS communication system do not receive the instruction. But the second transmission mode may transmit the instruction at full power which maximizes the range of the communication system. Any targets within the range of the communication system receive the instruction and are affected by the user action—e.g., the target is damaged by the attack. Thus, by controlling the transmission power of the LOS communication system, the toy device can produce effects corresponding to real-world user actions.

Figure 1:
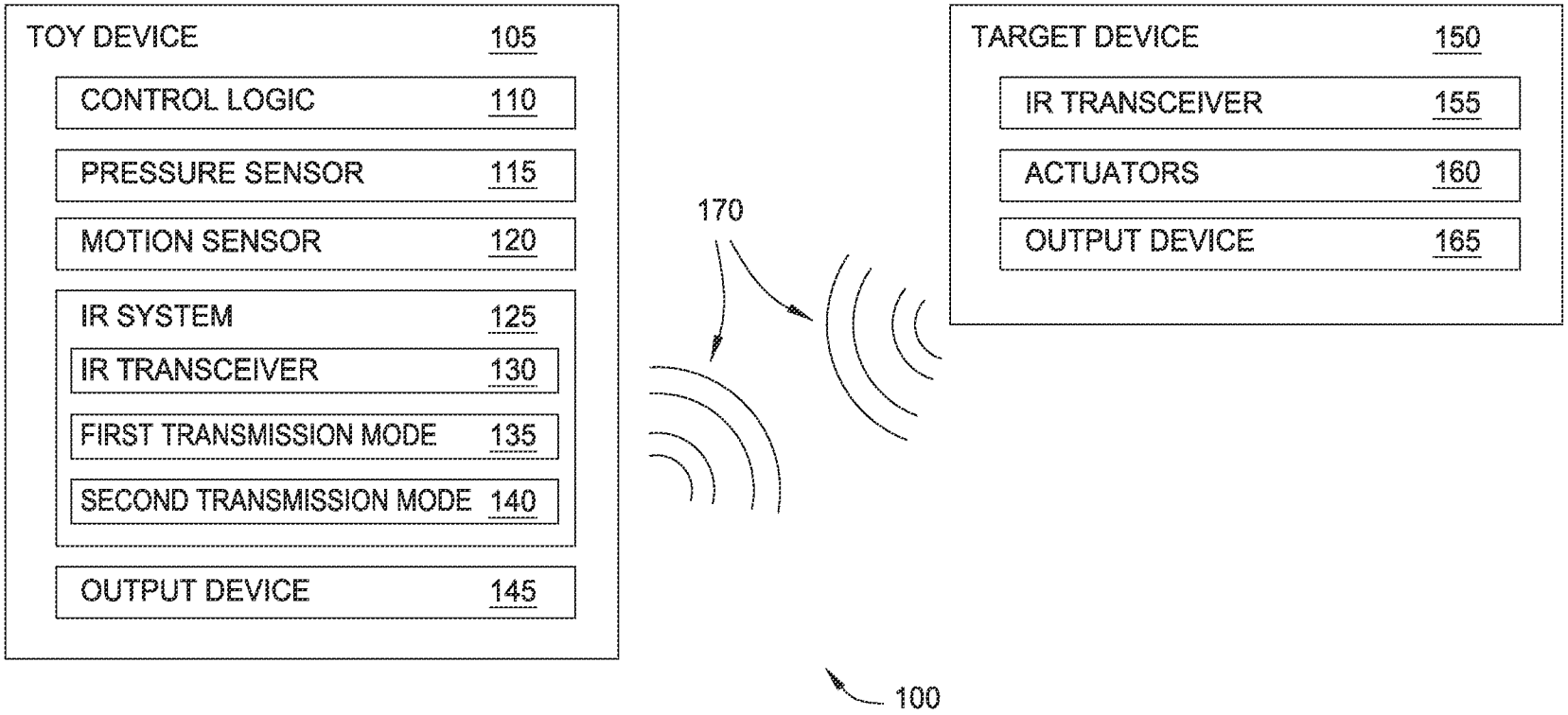
FIG. 1 is a block diagram of a communication system that uses two infrared transmission modes, according to one embodiment described herein.

FIG. 1 is a block diagram of an IR communication system 100 that uses two infrared transmission modes, according to one embodiment described herein. Although the discussion that follows describes using IR as the means for communicating between a toy device 105 and a target device 150, this disclosure is not limited to such. In other embodiments, different types of LOS communication system such as visible light communication may be used to communicate between the toy device 105 and target device 150. Moreover, other forms of wireless communication may be used to supplement the IR communication shown in FIG. 1 such as using RF or Bluetooth communication systems.

The toy device 105 uses IR signals 170 to communicate with target device 150. To do so, the toy device 105 includes control logic 110 which can include one or more integrated circuits such as a general processor or ASIC. Moreover, the control logic 110 can include firmware or execute software for transmitting instructions to the target device 150 using the LOS signals 170.

In one embodiment, the control logic 110 detects user actions using a pressure sensor 115 or motion sensor 120. For example, the toy device 105 may be an apparatus worn or attached to the user. As the user moves (e.g., runs, jumps, changes direction, moves an arm or hand, hits the toy device 105 against an object, etc.), these motions are detected by the pressure sensor 115 or the motion sensor 120. For example, the toy device 105 may be a glove worn on the hand of the user. If the user hits an object with the glove, the pressure sensor 115 can detect this contact and inform the control logic 110. Moreover, as the user moves the glove (e.g., makes a punching motion), the accelerations corresponding to this motion can be detected by the motion sensor 120 (e.g., an accelerometer, GPS, gyroscope, and the like) and reported to the control logic 110.

Based on the information captured by the sensors 115 and 120, the control logic 110 identifies the user action. In one embodiment, the control logic 110 determines if the user motion matches one of a plurality of predefined user actions such as punching, slashing, striking, shooting a laser, firing an arrow, and the like. For example, if the user moves the toy device 105 in a back and forth motion along a common axis, this motion may match the motion corresponding to a punching action. In this manner, the control logic 110 can interpret the user motion as one of a variety of different user actions.

The toy device 105 includes an IR system 125 for transmitting instructions to the target device 150 using the IR signals 170. The IR system 125 includes an IR transceiver 130, a first transmission mode 135 and a second transmission mode 140. The IR transceiver 130 transmits IR signals 170 to, and receives IR signals 170 from, the target device 150. In this embodiment, the control logic 110 selectively determines which of the two transmission modes 135, 140 to use when transmitting the IR signals 170 to the target device 150. In one embodiment, the control logic 110 decides which transmission mode to use depending on the action performed by the user. For example, if the user is performing a melee attack, the IR system 125 transmits an instruction to the target device 150 using the first transmission mode 135. However, if the user action is a ranged attack, the IR system 125 transmits an instruction using the second transmission mode 140.

In one embodiment, the first transmission mode 135 transmits the IR signals 170 using a different transmission pattern than the second transmission mode 140. For example, the effective distance of the transmission pattern of first transmission mode 135 may be smaller than the transmission pattern of the second transmission mode 140. Put differently, the distance from the toy device 105 at which an IR receiver can detect the IR signals 170 may vary depending on the current transmission mode. In one embodiment, the toy device 105 includes circuitry that changes an impedance in the IR system 125 which attenuates the output power of the IR signals 170 being transmitted by the IR transceiver 130. For example, in the first transmission mode 135, the IR system 125 may increase the impedance which decrease the output power of the IR signal 170, thereby decreasing the area or volume of the transmission pattern of the IR transceiver. However, when transmitting in the second transmission mode 140, the IR system may decrease the impedance thereby increasing the area of the transmission pattern of the IR transceiver 130. In another example, the IR system 125 may have separate circuitry (e.g., separate power sources or drivers) for the two transmission modes 135, 140. Depending on the user action, the IR system 125 may activate the circuitry of the transmission mode 135, 140 assigned to the identified user action.

The toy device 105 includes an output device 145 which may provide feedback to the user. This feedback may be audio, visual, haptic (e.g., vibrations), and the like. The control logic 110 may use the output device 145 to inform the user if a user action was detected. For example, if the user moves the toy device 105—e.g., a glove—to simulate punches, the control logic 110 can use the output device 145 to say "punch attack" thereby indicated to the user that the toy device 105 has detected the user is punching. Furthermore, if the control logic 110 cannot match the user motion to a predefined user action, the logic 110 can instruct the output device 145 to output "no action detected, try again" so the user can repeat the action. In this manner, the output device 145 can train the user how to effectively operate the toy device 105.

The target device 150 includes an IR transceiver 155, actuators 160, and an output device 165. The IR transceiver 155 receives the IR signals 170 from the toy device 105 and transmits confirmation IR signals 170 (i.e., a reply message) back to the toy device 105 thereby informing the control logic 110 that the instructions were received. Thus, if the toy device 105 transmits an instruction but never receives a confirmation message in return, the control logic 110 determines that no target devices 150 are within the range of the IR transceiver 130. In one embodiment, control logic 110 uses the output device 145 to inform the user that her action affected the target device 150.

The actuators 160 may be used to move some or all of the target device 150. The actuators 160 may include a vibration system, motors, gears, and the like. In one embodiment, the target device 150 includes an action figure that is moved by the actuators 160 in response to the instructions transmitted by the toy device 105. For example, if the user makes a punching motion, the toy device 105 may transmit an instruction to the target device 150 to control the actuators 160 so that the action figure moves in a manner like the figure was physically punched. Advantageously, using the IR signals to transmit instructions from the toy device 105 to the target device 150 permits the target device 150 to respond to the user action without the toy device 105 (or user) having to actually physical strike the target device 150.

Using IR signals (or more generally, LOS signals) instead of RF or Bluetooth signals to transmit the instructions may be preferred since the output power of the IR signals can be more easily controlled to simulate a range at which the user actions affect the target device 150. For example, if the user action is a melee attack, the first transmission mode 135 may be used which limits the signal range of the IR transceiver 130. If the target device 150 is outside of this limited range, then the toy device 105 does not receive a reply message from the target device 150, thereby informing the control logic 110 that the melee attack did not affect the target device 150.

The target device 150 also includes an output device which may output sound or videos. For example, the actuators 160 and the output device 165 may be used in tandem to simulate the effect of the user action on, for example, an action figure mounted on the target device 150. If the user action is a punch, while the actuators 160 move the action figure, the output device 165 may generate a grunting noise. In this manner, the user actions detected by the toy device 105 can affect the target device 150 without the two devices coming into physical contact.

Figure 2:
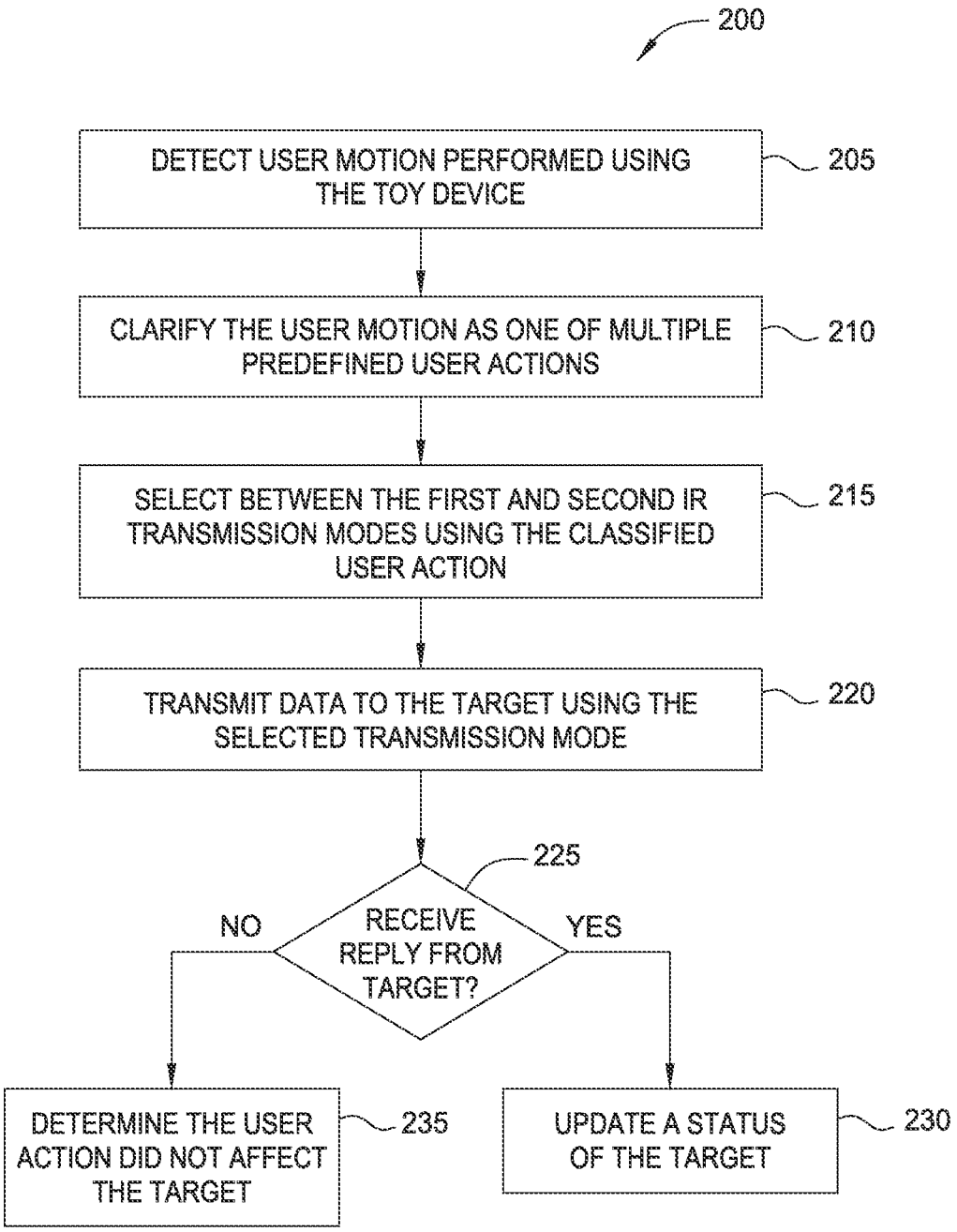
FIG. 2 is a flowchart of selecting between infrared transmission modes based on user actions, according to one embodiment described herein.

FIG. 2 is a flowchart of a method 200 of selecting between infrared transmission modes based on user actions, according to one embodiment described herein. At block 205, control logic on the toy device detects user motion. As described above, the toy device may include any number of pressure or motion sensors that detect user motions. For example, the control logic may detect when a user makes a punching motion, waves the toy device, rotates the toy device, strikes the toy device against a surface, and the like.

In one embodiment, the toy device may include one or more buttons that can be activated by the user. As used herein, the term "user motion" can include a user activating a button, interacting with a touch screen, pulling a trigger, and the like. The user interaction with these I/O devices may be used in combination with the user motions discussed above to provide instructions to the toy device. For example, the user may squeeze a button while performing a user motion (e.g., drawing back her arm as if she were about to shoot an arrow). Moreover, the control logic can detect a plurality of different user motions that may be performed sequentially. For example, the control logic may count the number of times a user moves the toy device in a punching motion or if the user performs two different motions back-to-back.

In one embodiment, the toy device may capture user motion using one or more image capturing devices (e.g., depth or image cameras). In this example, the toy device may not be attached to the user, but rather could be proximate to the user—e.g., facing the user such that the user motions are within the view of an image capturing device. As such, it is not necessary that the toy device be worn by the user in order to perform method 200.

At block 210, the control logic classifies the user motion as one of multiple predefined user actions. The control logic may include a table that maps a particular user motion (or combination of user motions) to a particular predefined action. For example, if the user moves the toy device rapidly in back and forth motion along a common axis, the control logic correlates this motion as a punch. If the user presses a button, moves the toy device along an axis, and then releases the button, the control logic may map these motions to drawing a bow and shooting an arrow. In other example, the user may strike the toy device against the ground which is mapped to creating a shockwave or earthquake. In these examples, the control logic compares the user motion measured at block 205 to predefined user motions corresponding to the user actions. For example, the control logic determines if the measured user motion matches the back and forth motion assigned to the punch action or if a slash motion made by the user matches the same slash motion corresponding to a sword swipe action. In this manner, the physical motions of the user can be correlated to virtual or simulated user actions.

At block 215, the control logic selects between first and second IR transmission modes using the classified user action. Similar to mapping the user actions to one or more user motions, the control logic may include a data structure that maps each user action to either the first or second transmission modes. In one embodiment, the user actions are divided into limited-range actions (e.g., melee attacks) and extended-range actions (e.g., ranged attacks). For example, if the user action is a sword slash, this is characterized as a limited-range action which uses the first transmission mode to transmit instructions. Conversely, if the user action is calling for help from another player, this is characterized as an extended-range action which uses the second transmission mode to transmit instructions. In this example, instead of attacking the target device, the toy device may transmit an IR instruction to a target device (e.g., a toy device representing a fellow super hero) for help to defeat an enemy.

At block 220, the control logic transmits data to the target using the selected transmission mode. As mentioned above, the transmission modes may correspond to different transmission patterns. While only two transmission modes are discussed, the toy device may include any number of modes that correspond to different transmission patterns—e.g., a low, medium, and high power transmission patterns.

The transmission modes may use other techniques for varying their patterns than varying the output power. For example, when in the first transmission mode, the IR system may use only one IR transmitter on the toy device (e.g., in the front of the device) to transmit instructions, while in the second transmission mode the IR system uses multiple IR transmitters that are located on different surfaces (e.g., the front, sides, and top of the toy device) to transmit instructions. Thus, even if the IR transmitters all individually output the same power, the combined outputs of the IR transmitters means the area or volume of the transmission pattern corresponding to the second transmission mode is greater than the transmission pattern for the first transmission mode.

In another embodiment, the toy device may include beam steering devices to vary the directionality of the IR transmitters thereby altering the transmission pattern of the IR system. In the first transmission mode, the beam steering device may focus the light emitted by the IR transmitter such that the IR signals strike only target devices directly in front of the toy device. However, when in the second transmission mode, the beam steering device may permit the IR transmitter to emit IR signals that radiate at multiple directions and strike target devices that are at the front, rear, or side of the toy device. In another example, during the first transmission mode, the toy device may use a unidirectional IR emitter to transmit the instructions but use an omnidirectional IR emitter when in the second transmission mode. Thus, as these examples illustrate, the embodiments herein are not limited to only changing the output power to alter the transmission pattern when switching between IR transmission modes.

In one embodiment, the control logic includes predefined codes that are transmitted using the IR signals. Each user action may correspond to its own unique code. The toy device may modulate the IR transmitter to transmit the selected code (e.g., logical ones and zeros) to the target device.

The target device includes logic for identifying the code and performing an action corresponding to the code. For example, if the code corresponds to a sword thrust, the target device may use actuators to raise an arm of an action figure to parry or deflect the user's thrust. If the code corresponds to a shockwave being emitted, the target device may use the actuators to cause the action figure to fall down. However, using predefined codes is just one example of enabling the target device to interact with the user. In another example, the toy device may transmit more detailed instructions such as particular settings for controlling the actuators or audio data which is outputted by the target device.

At block 225, the control logic determines if a reply is received from the target device. Once a target device receives the instruction transmitted at block 220, the device uses an IR transmitted to send a reply or confirmation back to the toy device thereby informing the toy device that the instruction was received. In one embodiment, the target device may transmit other information to the toy device. For example, the target device may provide state information to the toy device (assuming this state information is not maintained by the toy device) indicating the current "health" of the action figure on the target device. The target device may also instigate simulated counter attacks such as shooting a laser at the toy device which may decrease the "health" of the user. In another example, the target device may transmit a low battery warning to the toy device assuming the target device does not have its own output device capable of informing the user.

If the toy device receives the reply from the target device, at block 230, the control logic updates a state of the target device. As above, the state of the target may include the health of the target indicating how much damage has been taken and how much damage until the target is destroyed. The state may also include any counter attacks the target instigates at the user. For example, each time the user action hits the target (as indicated by the toy device receiving the reply), the control logic on the toy device may use a random number generator to determine if the target device performs a counter attack. The toy device may make the user aware of the counter attack using the output device. For example, the output device may generate audio that says, "Watch out! The target is swinging a sword at you!" The toy device may transmit another instruction to the target device which causes an action figure on the device to swing a sword. The user may then have to perform a user action to defend against this counter attack such as raising the toy device into a defensive position. If the control logic determines the user successfully performs a defensive action, the user's health is not affect. If not, the control logic may decrement the user's health. In this manner, the user and target device can perform a simulated fight.

If, however, the toy device does not receive the reply, method 200 proceeds to block 235 where the control logic determines that the user action did not affect the target. As such, the control logic does not change the status or health of the target. In one embodiment, the toy device uses the output device to inform the user that his attack was unsuccessful. Moreover, the toy device may suggest moving closer to the target device and repeating the user action or performing a ranged attack instead.

Although method 200 discusses transmitting IR instructions to a single target device by selecting between the two IR transmission modes, the instructions may be received by multiple target devices. That is, the user action may affect any target device which is within the range of the IR transmission modes. However, the user actions may affect only certain types of target devices. For example, a sword slash may affect a target device representing a person but not affect a target device representing a metallic robot. Here, the predefined code corresponding to the user action may be received at both target devices, but only the target device representing the person is affected. In contrast, the target device representing the robot may output audio stating, "Your sword is useless against me!" In this manner, method 200 may be performed in a simulated environment that includes any number of target devices.

Figure 3A:
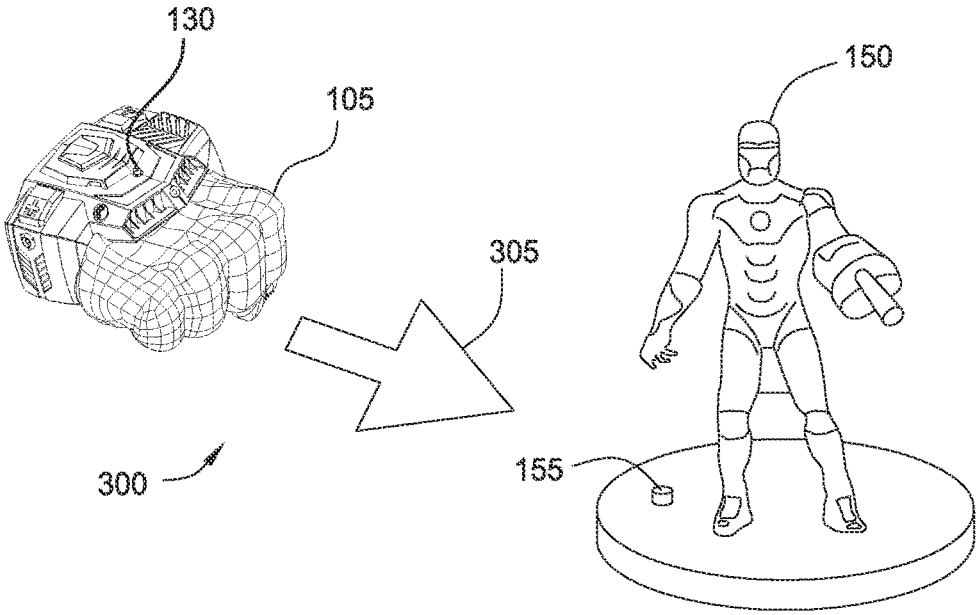
FIGS. 3A and 3B illustrate a user action triggering an infrared transmission mode, according to one embodiment described herein.
Figure 3B:
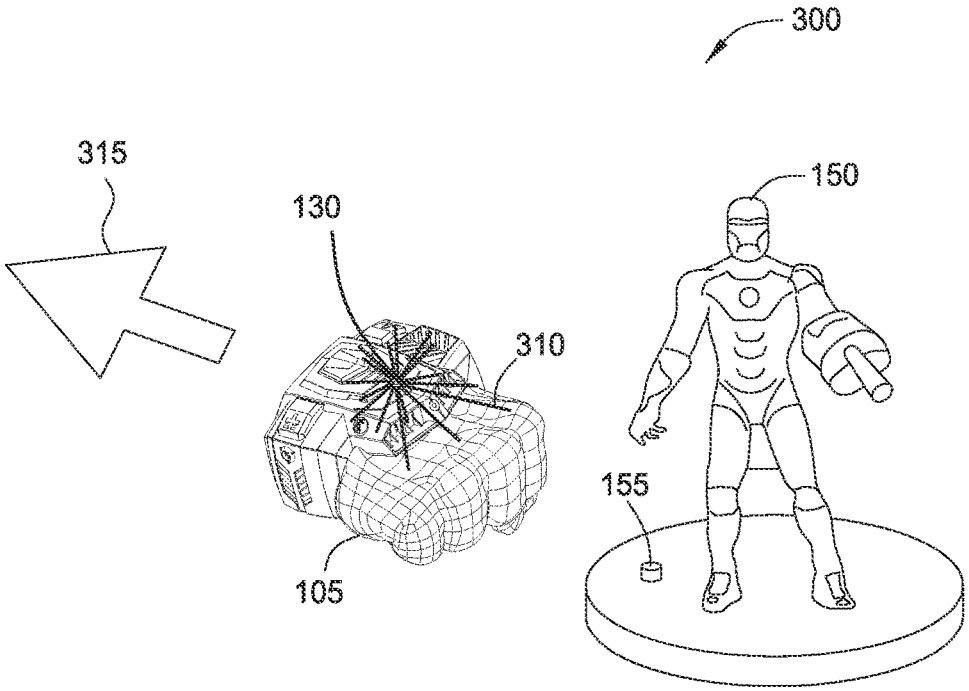

FIGS. 3A and 3B illustrate a user action triggering an infrared transmission mode, according to one embodiment described herein. Specifically, FIG. 3A illustrates an environment 300 that includes the toy device 105 (e.g., a hand or glove of a superhero character) interacting with the target device 150 that includes an action figure. In this example, the user may place his hand inside the toy device 105 in order to perform user actions. As shown by arrow 305, the user moves the toy device 105 towards the target device 150. The toy device 105 may include any number of accelerometers or gyroscopes that detect this motion. As described in method 200, control logic in the toy device 105 matches the user motion shown by arrow 305 to a predefined user action—e.g., a simulated punch.

In FIG. 3B, the control logic identifies the user action and selects one of a plurality of transmission modes to use when transmitting IR signals to the target device 150. In this example, the user action (e.g., a punch) corresponds to an IR transmission mode with limited range. As such, the signal 310 emitted from the IR transceiver 130 may be attenuated relative to the maximum output power of the transceiver 130. For example, the toy device 105 may increase the output impedance or use a lower voltage in order to emit the signal 310. As a result, the range of the IR transceiver 130 is reduced. If within this range, the IR transceiver 155 on the target device 150 receives the emitted IR signal 310, and in turn, transmits a reply message to the toy device 105.

As shown by arrow 315, the user may move the toy device 105 away from the target device 150. In response, control logic in the toy device 105 may instruct the IR transceiver 130 to stop emitting the IR signal 310. In other embodiments, the control logic may use a predefined timer to determine when to stop transmitting the IR signal 310 or may stop transmitting the signal once a reply message is received from the target device 150.

Figure 4A:
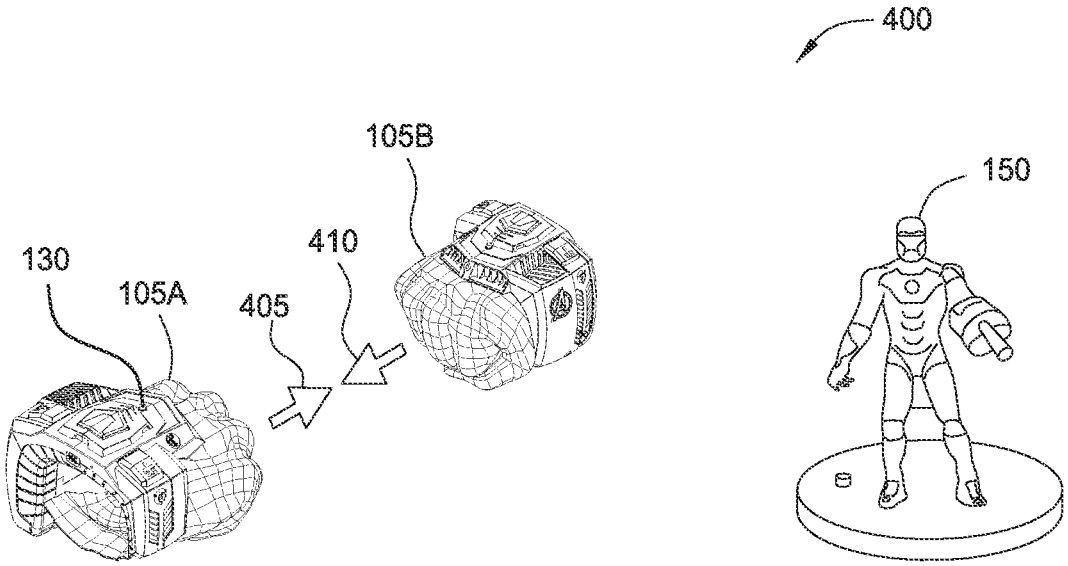
FIGS. 4A and 4B illustrate a user action triggering an infrared transmission mode, according to one embodiment described herein.
Figure 4B:
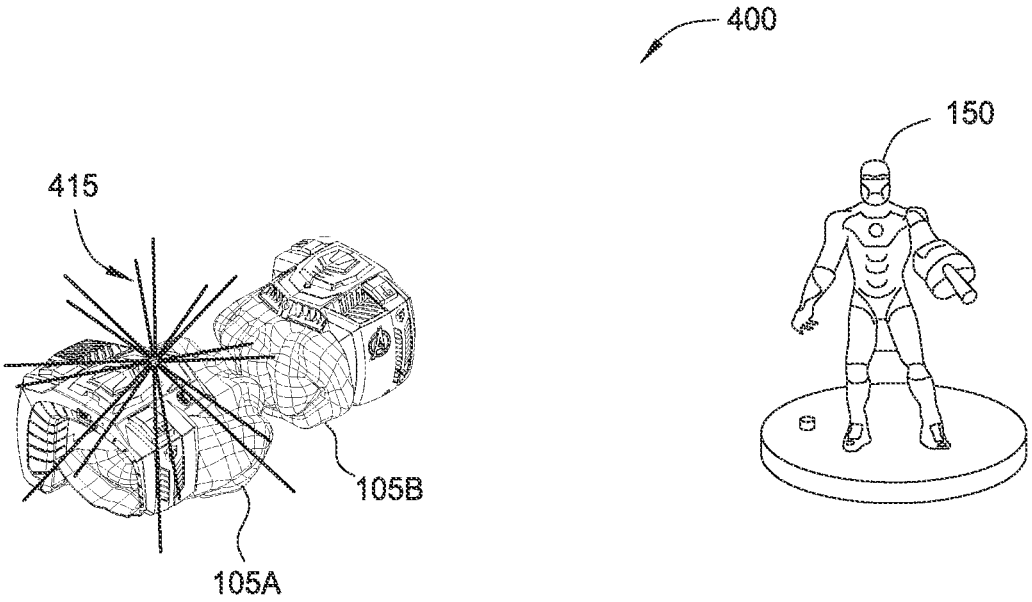

FIGS. 4A and 4B illustrate a user action triggering an infrared transmission mode, according to one embodiment described herein. Specifically, FIGS. 4A and 4B illustrates an environment 400 that includes toy device 105A and 105B which communicate with each other as well as the target device 150. In FIG. 4A, the user may place one of her hands into each one of the toy devices 105A and 105B. As shown by arrows 405 and 410, the user moves the devices 105A and 105B towards each other. This motion may be captured by the motion sensors in the toy devices 105A and 105B.

As will be discussed in more detail below, the toy devices 105A and 105B may include respective communication systems for transmitting data. For example, toy device 105B may transmit data captured from its motion sensors to toy device 105A. However, it is not necessary for both devices 105A and 105B to capture motion data, and in one embodiment, only toy device 105A includes motion or pressure sensors.

As shown in FIG. 4B, the user motion causes the two toy devices 105A and 105B to hit each other. Toy device 105A or 105B may include a pressure sensor for detected when the devices 105 are struck against a surface. In response to the data outputted by the pressure sensor, the control logic determines that the user action is a first smash that creates a simulated shockwave in environment 400. Because this action has a greater range than the simulated punch shown in FIGS. 3A and 3B, the control logic selects the IR transmission mode with a greater transmission than the mode used in FIGS. 3A and 3B. As such, the emitted IR signal 415 may extend further (i.e., is detectable at greater distances) than the IR signal 310 emitted in FIG. 3B. Thus, although target device 150 in FIG. 4B is further from the toy devices 105A and 105B than the target device 150 in FIG. 3B, the emitted signal 415 is nonetheless detectable at the target device 150. As discussed above, after receiving the emitted IR signal 415, actuators or output devices simulate an effect of the user action (e.g., the first smash) on the target device 150. For example, the action figure on the device 150 may vibrate or fall down.

FIGS. 3A, 3B, 4A, and 4B illustrate changing the range or output intensity of the IR signal depending on the user action. However, in other embodiments, changing IR transmission modes may change the directionality of the IR signal depending on the user action. For example, in FIG. 3B, the toy device may use a transmission mode that emits the IR signal 310 only in front of the toy device, while in FIG. 4B the toy device uses a transmission mode that emits the IR signal 415 using an omnidirectional transmitter. This may be desired when the user action affects only targets in a certain direction. For example, a punching action or shooting a laser or arrow may affect only targets directly in front of the toy device 105. As such, the toy device may transmit the IR signal only in a direction in front of the device 105. However, when simulating a shockwave or earthquake, the toy device 105 selects a transmission mode that outputs the IR signal in multiple directions.

Figure 5:
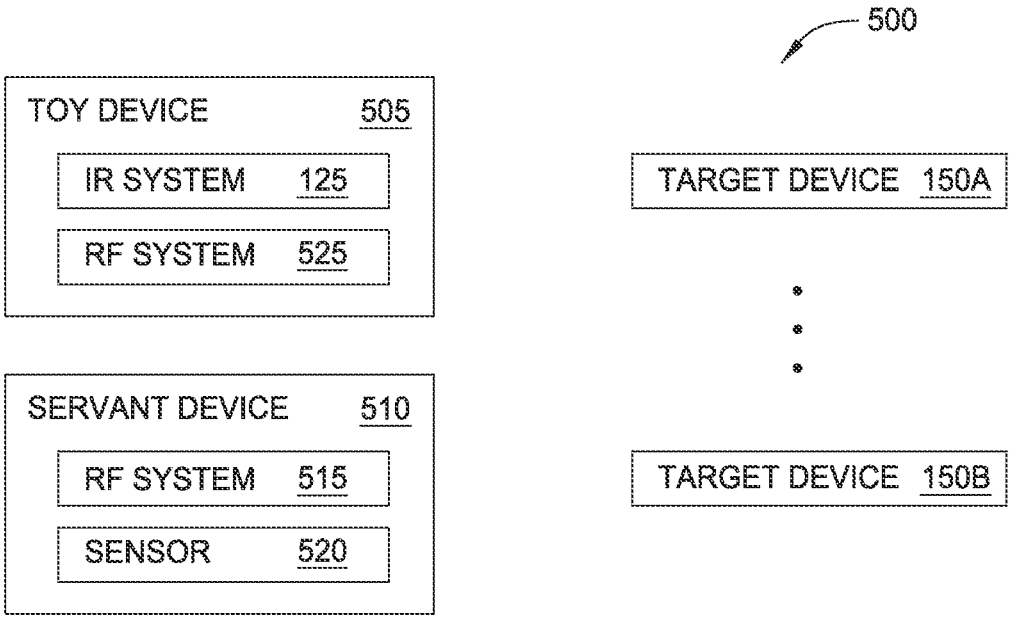
FIG. 5 is a block diagram of a toy system that includes a master and servant toy device, according to one embodiment described herein.

FIG. 5 is a block diagram of a communication system 500 that includes a master and servant toy device, according to one embodiment described herein. As shown, communication system 500 includes the master device 505, the servant device 510, and multiple target devices 150. This arrangement may be used in the environment 400 illustrated in FIG. 4A, where toy device 105A is the master device 505 and toy device 105B is the servant device 510.

The toy device 505 can be the same as toy device 105 illustrated in FIG. 1 except that toy device 505 includes an RF system 525 as well as the IR system 125 for communicating with external devices. In one embodiment, the RF system 525 may be used to communicate with the servant device 510, while the IR system 125 is used to communicate with the target devices 150. However, this is not a requirement. In other embodiments, the master device 505 and servant device 510 may communicate using the IR system 125. Using the RF system 525 for this purpose, however, may be preferred since circuitry for performing RF communication may be cheaper to implement and does not rely on line-of-sight to communicate. Thus, an object (e.g., the body of the user) may occlude the master device 505 from the servant device 510 and the two devices can still communicate using RF signals. In one embodiment, the RF system 525 in the master device 505 and the RF system 515 in the servant device 510 may transmit RF signals that are 2.7 GHz or greater. Moreover, the master device 505 may use the RF system 525 to communicate with a network as well. As will be discussed later, the master device 505 may be part of a network storytelling environment and use 2.7 GHz radio signals to communicate with the other devices in the network.

The servant device 510 includes an RF system 515 and sensor 520. The RF system 515 on the servant device 510 communicates with the RF system 525 on the master device 505. For example, the servant device 510 may use the RF system 515 to transmit the data captured by the sensor 520 (e.g., an accelerometer, gyroscope, pressure sensor, etc.) to the master device 505. In one embodiment, the servant device 510 may lack many of the components that are in the master device 505 such as control logic for performing method 200, output devices, etc. As such, transmitting the data captured by the sensor 520 to the master device 505 means that servant device 510 does not need control logic to process the data. By arranging the toy devices in a master/servant relationship, the servant can be a scaled down version of the master which saves costs.

In operation, the control logic on the master device 505 processes the motion and pressure data captured by local sensors as well as the sensor 520 on the servant device 510. Using this data, the control logic performs method 200 and transmits instructions to the target devices 150. Thus, the servant device 510 does not need its own IR system, further reducing costs. In system 500, the user can still use the servant device 510 to interact with the target devices 150 without requiring the servant device 510 to include all the same components as the master device 505. For example, some user actions may require the user to move both devices 505 and 510 such as double punching, slamming both devices 505 and 510 together, or slamming both devices 505 and 510 on the ground. Using the sensor 520, the system 500 can detect the user motion of the servant device 510 and transmit this data to the master device 505 using the RF systems 515 and 525. The control logic in the master device 505 then determines whether the user successfully performed the user action and transmits instructions to the target devices 150 as described above.

Figure 6A:
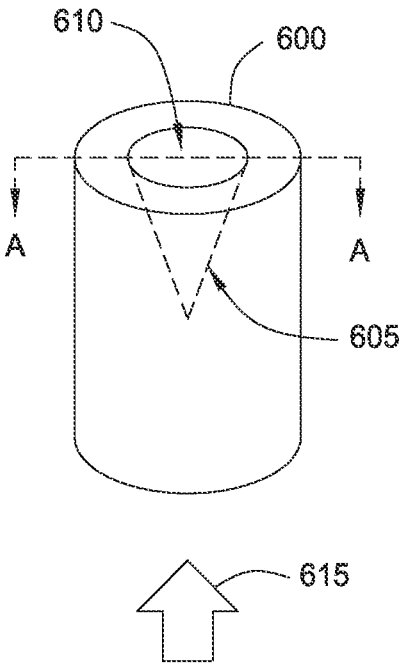
FIGS. 6A and 6B illustrate an infrared transmission system, according to one embodiment described herein.
Figure 6B:
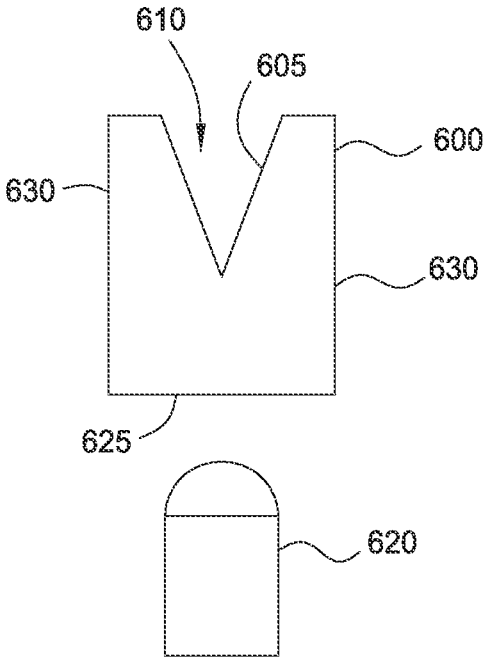

FIGS. 6A and 6B illustrate an infrared transmission system, according to one embodiment described herein. FIG. 6A illustrates a reflector 600 for generating an omnidirectional IR transmitter. The reflector 600 may be made of a transparent material which permits IR signals to pass through. For example, the reflector 600 may be made from a glass or transparent plastic material.

As shown by arrow 615, light emitted from an IR source (e.g., an IR laser or IR LED) enters through a bottom surface of the reflector 600. For example, the reflector 600 may be exposed on an outer surface of a toy or target device while the IR source is recessed below the outer surface. As the IR light travels up through the reflector 600, some of the light strikes the conical surface 605 formed in the upper surface of the reflector 600. The reflector 600 includes an indentation 610 which forms the conical surface 605. The shape of the indentation 610 may be selected such that the IR light traveling up the reflector 600 strikes the conical surface 605 and is reflected out in a radial direction that is substantially perpendicular with the direction defined by arrow 615. If light strikes the entire surface of the conical surface 605, this reflected light is reflect in 360 degrees around the reflector 600. Stated differently, the reflector 600 may output IR signal in a plane that is perpendicular to the direction defined by arrow 615. In this manner, the IR reflector 600 can be used to form an omnidirectional IR transmitter.

FIG. 6B illustrates a cross section of reflector 600 as defined by the line A-A in FIG. 6A. As shown, an IR source 620 is located below a bottom surface 625 of the reflector 600 which emits light through the reflector 600 until the light strikes the conical surface 605 formed by the recess 610. As above, the conical surface 605 changes the direction of the light such that at least a portion of the light is radiated out of the reflector 600 at the side surface 630. In one embodiment, while in a first transmission mode, the output power of the IR source 620 is attenuated such that the range of the IR signals emitted by the reflector 600 are reduced relative to a second transmission mode where the output power of the IR source 620 is not attenuated or has a lesser attenuation than when the IR source 620 is in the first transmission mode.

Figure 7:
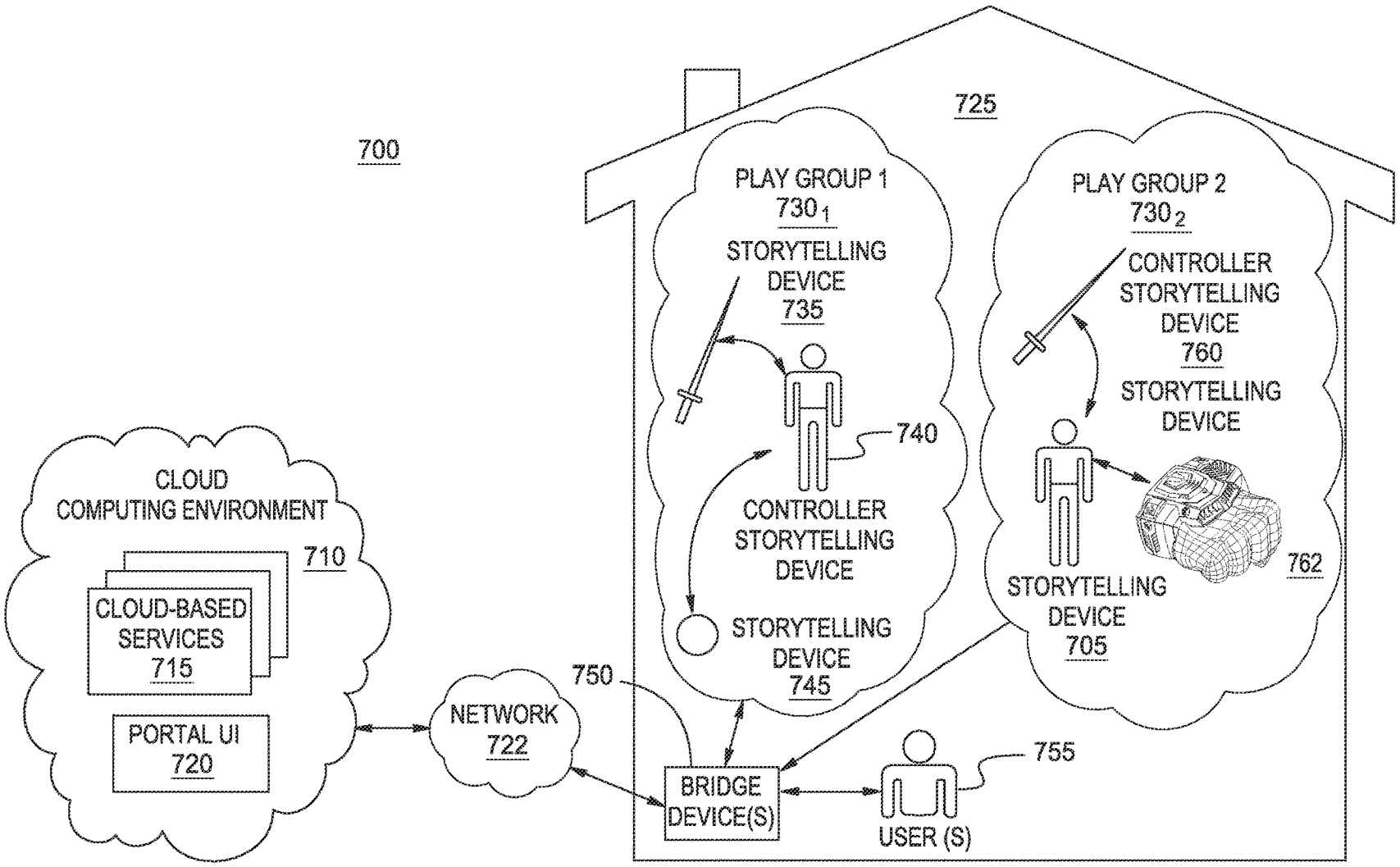
FIG. 7 illustrates an example storytelling environment, according to one embodiment described herein.

FIG. 7 illustrates an example storytelling environment, according to one embodiment. As shown, the environment 700 includes a cloud computing environment 710 and a home environment 725, interconnected via network 722. The home environment 725 includes two playgroups $\mathbf{730}_{1\text{-}2}$ of storytelling devices (e.g., the toy device 105 or target device 150 discussed in FIG. 1), as well as a user(s) 755 and a bridge device(s) 750. Here, the user may connect to the bridge device 750 via an application (e.g., executing on a mobile device, rendered within a web browser, etc.). The cloud computing environment 710 hosts a plurality of services 715 and a portal user interface 720.

Generally, cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. Doing so allows a user to access information and the services 715 from any computing system attached to a network connected to the cloud (e.g., the Internet).

Each playgroup $\mathbf{730}_{1\text{-}N}$ generally represents a set of storytelling devices involved in a unique storytelling or playtime experience. For instance, the playgroup $\mathbf{730}_1$ represents a science fiction-themed storytelling experience and includes a light sword storytelling device 735, an action figure controller storytelling device 740, and a trainer storytelling device 745. Likewise, the playgroup $\mathbf{730}_2$ also represents a science fiction-themed storytelling experience and includes a light sword controller storytelling device 760, a hand device 762 (e.g., toy device 105 in FIG. 3A), and an action figure storytelling device 765. More generally, however, the playgroups may contain any number of storytelling devices of any number of different themes and types. In one embodiment, the devices in the playgroups 730 may use RF systems (e.g., 2.7 GHz or greater communication signals) to communicate with the bridge device 750 and the network 722.

Generally, the playgroups 730 include storytelling devices within a particular physical location (e.g., a room of the house environment 725). That is, in one embodiment, it may be preferable for a storytelling experience to only interact with storytelling devices within its immediate physical proximity (e.g., within the same room), as to do otherwise can potentially create security and other problems during the storytelling experience. A number of different techniques may be used to determine which storytelling devices are within immediate physical proximity of one another. For example, one or more of the storytelling devices could emit a first signal (e.g., an infrared signal) and the other storytelling devices could be configured to transmit a response (e.g., a radio frequency signal (RF)) upon receiving the first signal. The storytelling device(s) could then receive the responses from the other storytelling devices and could create a playgroup 730 that includes the other storytelling devices as well as the one or more storytelling devices. Moreover, although cloud computing environment 1510 is shown, in other embodiments, the devices in the play groups 730 may communicate only with each other without using the bridge device 750 and network 755.

As shown, the devices 740 and 760 have been elected as controller devices within the playgroups $\mathbf{730}_{1\text{-}2}$. Generally, a controller device configures each of the storytelling devices within a playgroup to perform certain actions in response to a detected stimulus event and a current context of the story being told. Here, the story may include a number of different contexts in a temporal order, and the playback of the story may advance from one context to the next until the last context is reached and the storytelling experience is complete. However, while the story may be linear in progression, this is not necessary. For example, a story could have different branches so that the story can proceed down one of many possible arcs. For instance, arcs could be randomly selected, selected based on a user's request (e.g., the user specifying which arc should be taken), selected based on the user's actions (e.g., the user manages to "rescue" one of the fictional characters in the story), selected based on the user's history of actions (e.g., whether the user is trending towards the "dark side" in a science fiction storyline), and so on. Moreover, the story may be modified dynamically during playback based on various actions, such as one of the storytelling devices becoming unavailable (e.g., losing power, leaving the physical environment, etc.) or a new storytelling device being introduced to the environment (e.g., the user's friend comes over to play, bringing one or more new storytelling devices with him).

Additionally, the controller may maintain state information and control game logic for the playgroup 730. For example, playgroup $\mathbf{730}_1$ could be playing out a story in which a user is asked by the action figure device 740 to deflect virtual laser beams fired from the trainer device 745, using the light sword device 735. Here, the elected controller device (i.e., action FIG. 740) could maintain a "hit points" value for the user that is decremented when the user fails to deflect one of the virtual lasers, and could further maintain a count of how many virtual lasers the user has deflected thus far. Additionally, the controller could retrieve state data for the user (e.g., by querying one of the cloud-based services 715 with an identifier for the user) and could use the user state data to adjust the playback of the story.

In addition to detecting nearby storytelling device within the same physical environment, the storytelling devices within a playgroup 730 may elect one of the storytelling devices as a controller storytelling device. A number of different techniques may be used for such an election. For example, a user could explicitly specify that a particular one of the storytelling devices (e.g., the user's favorite device) should be used as the controller. Here, it may be preferable for the user to select a device that will remain with the user throughout the storytelling experience, so as to avoid a subsequent controller election part-way through the story. In one embodiment, the controller may be elected based on technical specifications and properties of the storytelling devices. For example, a storytelling device with a substantial amount of memory, processing power and communication bandwidth may be preferable as the controller, relative to a device having a lesser amount of computing resources.

As discussed above, the story may generally include stimulus events and corresponding actions, and may be linear in progression or dynamic (e.g., a story that includes different story arcs or branches). In one embodiment, the story may be defined such that each corresponding action is attribute to a type or role of storytelling device (i.e., as opposed to a specific storytelling device). In mapping the story to the available and compatible storytelling devices, the controller device 720 could determine a type of each of the storytelling devices, and could assign particular stimulus events and corresponding actions to each of the storytelling devices based on the determined type. For example, a particular story could state that an action should be performed by a storytelling device having the role of "Hero", and the controller could map the action onto a storytelling device within the playgroup having the role "Hero".

Once the controller maps the story onto the devices, the controller configures each of the storytelling devices with a number of stimulus events and corresponding effects relating to a first context of the story. As an example, the action FIG. 740 could detect when the user has successfully deflected a virtual laser fired from the storytelling device 745 (i.e., an occurrence of the stimulus event), and could audibly congratulate the user in response (i.e., performing the corresponding effect).

In the preceding, reference is made to embodiments of the invention. However, it should be understood that the invention is not limited to specific described embodiments. Instead, any combination of the preceding features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A method of operating a toy device, comprising:

detecting user motion using the toy device;

selecting a user action from a plurality of predefined user actions based on the user motion, wherein each of the plurality of predefined user actions corresponds to a respective effective distance;

selecting, based on the selected user action, only one of a plurality of line-of-sight (LOS) transmission power levels to simulate the respective effective distance of the selected user action, wherein each of the plurality of LOS transmission power levels corresponds to a respective one of the plurality of predefined user actions; and transmitting, using the selected LOS transmission power level, a data signal corresponding to the selected user action using a LOS communication system.

2. The method of claim 1, wherein transmitting the signal using the LOS communication system comprises:

transmitting the data signal to a target device, wherein data of the data signal is configured to instruct the target device to simulate an effect caused by the selected user action.

3. The method of claim 2, wherein the selected user action is a simulated attack selected from i) a melee attack and ii) a ranged attack, wherein the data instructs the target device to activate an actuator to simulate a visual effect of the simulated attack on the target device, wherein a first one of the plurality of LOS transmission power levels corresponds to a melee attack and a second one of the LOS transmission power levels corresponds to the ranged attack, and wherein an effective distance of the melee attack is less than an effective range of the ranged attack.

4. The method of claim 1, wherein the LOS communication system is an infrared (IR) communication system.

5. The method of claim 1, further comprising:

receiving a reply from a target device in response to transmitting the data signal, wherein the reply is encoded in a LOS signal, wherein the reply encoded in a LOS signal comprises a confirmation that the data signal was received by the target device.

6. The method of claim 1, wherein, when the selected LOS transmission power level is a first power level, only one of a plurality of transmitters transmits the data signal, and wherein, when the selected LOS transmission power level is a second power level greater than the first power level, more than one of the plurality of transmitters transmit the data signal.

7. The method of claim 1, further comprising:

upon determining a reply is not received from any target device after transmitting the data signal, determining that no target device was affected by the selected user action.

8. The method of claim 1, wherein detecting the user motion using the toy device comprises:

measuring the user motion using one or more sensors disposed on the toy device; and comparing the user motion to motions corresponding to the plurality of predefined user actions.

9. The method of claim 1, wherein the selected LOS transmission power level has a smaller effective range than a second LOS transmission power level of the plurality of LOS transmission power levels.

10. The method of claim 9, further comprising:

switching from the selected LOS transmission power level to the second LOS transmission power level, wherein an output power of an IR transmitter is increased when switching from the selected LOS transmission power level to the second LOS transmission power level.

11. A computer-readable storage medium comprising computer-readable program code embodied therewith, the computer-readable program code is executable by one or more computer processors to perform an operation comprising:

detecting user motion using a toy;

selecting a user action from a plurality of predefined user actions based on the user motion, wherein each of the plurality of predefined user actions corresponds to a respective effective distance;

selecting, based on the selected user action, only one of a plurality of line-of-sight (LOS) transmission power levels to simulate the respective effective distance of the selected user action, wherein each of the plurality of LOS transmission power levels corresponds to a respective one of the plurality of predefined user actions; and transmitting, using the selected LOS transmission power level, a data signal corresponding to the selected action using a LOS communication system.

12. The storage medium of claim 11, wherein transmitting the signal using the LOS communication system comprises:

transmitting the data signal to a target device, wherein data of the data signal is configured to instruct the target device to simulate an effect caused by the selected user action, wherein the selected user action is a simulated attack, wherein the data instructs the target device to activate an actuator to simulate a visual effect of the simulated attack on the target device.

13. The storage medium of claim 11, wherein the operation further comprises:

receiving a reply from a target device in response to transmitting the data signal, wherein the reply is a LOS signal; and in response to receiving the reply, updating state information corresponding to the target device indicating the target device was affected by the selected user action.

14. The storage medium of claim 11, wherein detecting the user motion using the toy device comprises:

measuring the user motion using one or more sensors disposed on the toy device; and comparing the user motion to predefined motions corresponding to the plurality of predefined user actions.

15. The storage medium of claim 11, wherein the selected LOS transmission power level of the plurality of LOS transmission power levels has a smaller effective range than a second LOS transmission power level of the plurality of LOS transmission power levels.

16. A toy device, comprising:

a line-of-sight (LOS) communication system;

at least one sensor; and control logic configured to:

detect user motion using the at least one sensor;

select a user action from a plurality of predefined user actions based on the user motion, wherein each of the plurality of predefined user actions corresponds to a respective effective distance;

select, based on the selected user action, only one of a plurality of LOS transmission power levels to simulate the respective effective distance corresponding to the selected user action, wherein each of the LOS transmission power levels corresponds to a respective one of the plurality of predefined user actions; and instruct the LOS communication system to transmit a data signal corresponding to the selected action using the selected LOS transmission power level.

17. The toy device of claim 16, wherein the LOS communication system is configured to:

transmitting the signal to a target device, wherein data of the data signal is configured to instruct the target device to simulate an effect caused by the selected user action, wherein the selected user action is a simulated attack, wherein the data instructs the target device to activate an actuator to simulate a visual effect of the simulated attack on the target device.

18. The toy device of claim 16, wherein the LOS communication system comprises:

an IR transmitter configured to transmit the data signal; and an IR receiver configured to receive a reply from a target device, wherein, in response to receiving the reply, the control logic is configured to update state information corresponding to the target device indicating the target device was affected by the selected user action.

19. The toy device of claim 16, wherein detecting the user motion using the toy device comprises:

comparing the user motion to predefined motions corresponding to the plurality of predefined user actions.

20. The toy device of claim 16, wherein the selected LOS transmission power level has a smaller effective range than a second LOS transmission power level of the plurality of LOS transmission power levels.

* * * * *